US006745547B2

(12) United States Patent
Bussey, Jr. et al.

(10) Patent No.: US 6,745,547 B2
(45) Date of Patent: Jun. 8, 2004

(54) CARTRIDGE FOR A BAGGING MACHINE

(76) Inventors: Harry Bussey, Jr., 960 Cape Marco Dr., Unit 1803, Marco Island, FL (US) 33937; Harry (Buddy) Bussey, III., 4 Windy Hill, Atlantic Highlands, NJ (US) 07716

( * ) Notice: Subject to any disclaimer, the term of this patent is extended or adjusted under 35 U.S.C. 154(b) by 0 days.

(21) Appl. No.: 10/143,170

(22) Filed: May 6, 2002

(65) Prior Publication Data

US 2003/0205035 A1 Nov. 6, 2003

(51) Int. Cl.[7] ..... B65B 43/42

(52) U.S. Cl. ..... 53/576; 53/450; 53/457; 53/459; 53/474

(58) Field of Search ..... 53/450, 451, 457, 53/459, 574, 576

(56) References Cited

U.S. PATENT DOCUMENTS

| | | | | | |
|---|---|---|---|---|---|
| 3,403,410 | A | | 10/1968 | Benzel et al. | 4/144.2 |
| 4,430,772 | A | * | 2/1984 | Michel et al. | 452/32 |
| 4,442,568 | A | * | 4/1984 | Petry | 452/38 |
| 4,446,677 | A | * | 5/1984 | Kokido | 53/577 |
| 4,500,314 | A | | 2/1985 | Brendling | 604/348 |
| 4,505,003 | A | * | 3/1985 | Becker et al. | 452/38 |
| 4,734,956 | A | * | 4/1988 | Frey et al. | 138/118.1 |
| 4,820,290 | A | | 4/1989 | Yahr | 604/349 |
| 4,863,448 | A | | 9/1989 | Berg | 604/349 |
| 4,886,509 | A | | 12/1989 | Mattsson | 604/349 |
| 4,963,137 | A | | 10/1990 | Heyden | 604/349 |
| 4,993,210 | A | * | 2/1991 | Kollross | 53/428 |
| 5,084,037 | A | | 1/1992 | Barnett | 604/349 |
| 5,342,332 | A | | 8/1994 | Wheeler | 604/349 |
| 5,368,583 | A | | 11/1994 | Fleury | 604/318 |
| 5,745,926 | A | | 5/1998 | Cailleteau | 4/144.1 |
| 5,782,061 | A | * | 7/1998 | Clazie et al. | 53/451 |
| 5,827,250 | A | | 10/1998 | Fujioka et al. | 604/349 |
| 5,899,049 | A | * | 5/1999 | Fuss et al. | 53/459 |
| 6,216,425 | B1 | * | 4/2001 | Hanten | 53/450 |
| 6,443,930 | B1 | | 9/2002 | Silverstein | 604/353 |
| 6,560,948 | B1 | * | 5/2003 | Fuss et al. | 53/459 |
| 6,565,548 | B1 | | 5/2003 | Glaug et al. | 604/385.03 |

FOREIGN PATENT DOCUMENTS

| | | | |
|---|---|---|---|
| EP | 0 997 126 A2 | 3/2000 | A61F/13/471 |
| EP | 1 086 679 A2 | 3/2003 | A61F/13/471 |

* cited by examiner

*Primary Examiner*—Stephen F. Gerrity
*Assistant Examiner*—Hemant M Desai
(74) *Attorney, Agent, or Firm*—Francis C. Hand; Carella, Byrne, Bain etal

(57) ABSTRACT

A cartridge is provided that can be attached in depending relation to the chute of a bagging machine in order to supply material to form several bags. The cartridge employs a hollow mandrel on which a tube of plastic film is mounted in a collapsed state. The tube is capable of being pulled off the mandrel in an automatic manner. The cartridge also includes a spreader bar at the lower end of the mandrel to brake the movement of the tube off the mandrel when in use.

24 Claims, 5 Drawing Sheets

CARTRIDGE FOR A BAGGING MACHINE

This invention relates to a cartridge for a bagging machine. More particularly, this invention relates to a cartridge for replenishing a tube of material to a bagging machine for packaging particulate material.

Heretofore, various types of filling or bagging machines have been used for filling bags with particulate materials, such as foamed plastic packing elements. For example, U.S. Pat. No. 6,035,606 describes a filling machine in which a bag is suspended within an opening of a conveyor. As the conveyor moves the bag past various stations, air is blown into the bag to open the bag, a flow of particulate material is then delivered into the bag and the bag is thereafter closed at an upper end while still suspended from the conveyor.

Bagging machines of the above type require manual placement of a bag on the conveyor. As a result, there is a risk that a bag may be damaged when initially placed on the conveyor. Further, a relatively long time is required in order to place a series of empty bags on the conveyor for filling.

Accordingly, it is an object of the invention to reduce the time required to fill bags with particulate material.

It is another object of the invention to be able to fill a series of bags with particulate material in an efficient manner.

It is another object of the invention to reduce the time required for filling a series of plastic bags with loose fill materials.

Briefly, the invention provides a cartridge that can be mounted on the chute of a bagging machine and that is able to dispense a continuous stream of tube for the making and filling of several bags.

In accordance with the invention, the cartridge includes a hollow mandrel that can be mounted in suspended relation from a chute of a bagging machine for passage of a flow of material from the bagging machine. In addition, the cartridge has a collapsed tube of material, such as a tube of plastic film, disposed on the mandrel for dispensing therefrom to form a plurality of bags for sequentially receiving the material dispensed through the mandrel.

The mandrel includes a means at one end for securement to a chute of a bagging machine. In one embodiment, this means is in the form of a radially outwardly directed collar for engagement with a flange or the like on the chute. In another embodiment, this means is in the form of a pair of L-shaped slots in the end of the mandrel for receiving a pair of outwardly projecting pins on the chute in a bayonet type connection.

The mandrel also has means at each end for holding the collapsed tube of material on the mandrel. In one embodiment, a collar at the end of the mandrel serves to secure the mandrel to a chute while also serving to hold the collapsed tube inplace. In another embodiment, a bar is removably mounted in one end of the mandrel with the ends of the bar projecting from the mandrel in order to maintain the collapsed tube of material on the mandrel at that end.

In accordance with the invention, in order to place a plastic tube on the mandrel, the mandrel is mounted with the collar end down. A means is then provided for delivering a continuous tube of plastic film onto the mandrel and against the collar in a collapsed state. In this respect, the means for delivering the tube may be of any suitable construction. Typically, this means delivers a plastic tube having an inside diameter which is greater than the outside diameter of the mandrel so that the delivered tube is "shuffled" onto the mandrel to take on a collapsed condition. In this way, a length of tubing may be disposed on the mandrel which is a multiple of the length of the mandrel. For example, for a mandrel having a length of 48 inches and an outside diameter of 16 inches, a 600 foot length of plastic tube of 1.5 mil. thickness and 24 inches inside diameter may be disposed on the mandrel. This length of plastic tube may be used to fill about 100 bags of material. Typically, the tube has a length at least 100 times the length of the mandrel.

After the plastic tube has been shuffled onto the mandrel, the bar is slidably mounted in the now upper end of the mandrel in order to maintain the plastic film on the mandrel for transport purposes.

When the mandrel is to be coupled to a chute of a bagging machine, the mandrel is inverted so that the collar end faces the chute. After coupling of the mandrel to the chute via the collar, the plastic tube is maintained in place by the projecting ends of the bar. In accordance with invention, the bar is provided with curved ends and is rotatable in the mandrel between a first position with the curved ends facing towards the collar to maintain a collapsed tube on the mandrel and a second position with the curved ends facing in the opposite direction to cause spreading of the tube during movement of the tube over the bar and off the mandrel. That is to say, after the mandrel has been mounted in place, the bar is rotated so that the curved ends face downwardly. An operator may then initiate movement of the tube off the mandrel by pulling the open end of the tube downwardly over the bar that then acts as a spreader bar to spread the bag towards a flattened condition for purposes of sealing.

After the bag has been pulled from the mandrel, the bag is moved into a means for forming a series of spaced apart transverse seals in the tube to define a series of closed bags of the material dispatched through the mandrel. For example, use may be made of a heat sealing means to form a seal across of the tube.

In the embodiment where the mandrel is without a collar at the end, the tube is shuffled onto the mandrel from either end. Any suitable means, such as a tape, may be used to hold the respective ends of the tube in place for transport. For example, the forward end of the tube may be held on one end of the mandrel by an adhesive tape. After shuffling the tube onto the mandrel, the trailing end is held on by a second adhesive tape. Such a cartridge may then be shipped or transported to a user as a cylindrical unit. When the mandrel is subsequently mounted on a chute of a bagging machine, the user would insert a bar, as described above, through a pair of diametrically opposed openings in the lower end of the mandrel and the tape at that end would be removed to free the tube for removal. The tube would then be removed from the mandrel as described above.

The cartridge provides a plastic tube to the bagging machine that is sufficient to make and fill a multitude of bags with loose fill material. For example, when the plastic tube is first pulled from the mandrel, a heat sealing means forms a seal across the bag. Thereafter, a charge of loose fill material is discharged from the chute through the mandrel and into the plastic tube. Next, the sealing means forms a transverse seal across the tube above the level of the loose fill material thereby closing a "bag". At the same time, the heat sealing means forms the bottom of the next "bag". A suitable severing means is also provided to cut the tube within a seal or between two adjacent seals so that the lowermost "bag" may be deposited onto a conveyor or other transport means for conveying the closed bag away from the bagging machine.

The bagging machine is thus able to fill several bags until the plastic tube on the cartridge has been exhausted. At that time, a fresh cartridge may then be put into place on the bagging machine to form another series of filled bags of loose fill material.

Continued pulling of the collapsed tube from the mandrel occurs either manually or automatically using any suitable type of pulling means, for example, using the heat sealing means or another means located at or near the heat sealing means. For example, where the heat sealing means is used to pull the plastic tube from the cartridge, after the heat sealing means first engages the tube to form a transverse seal across the tube, the heat sealing means moves downwardly thereby pulling the tube along as a charge of loose fill material is dispensed into the bag. Upon reaching a lowermost position, the heat sealing means disengages from the tube and moves out of the path of the now filled tube. At this time, the tube ceases to unravel from the mandrel. The heat sealing means then moves to an uppermost position and re-engages the tube to form a seal to close off the top of the "bag" and to again pull the tube off the mandrel.

The projecting ends of the bar on the cartridge serve as a means to spread the otherwise cylindrically shaped tube towards a flattened shaped to facilitate engagement by the heat sealing means to form the transverse seals across the tube. The projecting ends of the bar also brake the movement of the collapsed tube from the mandrel so that the tube does not simply unravel under its own weight or a manually or automatically applied pulling force.

These and other objects and advantages of the invention will become more apparent from the following detailed description taken into conjunction with the accompanying drawings wherein.

Figure 1:
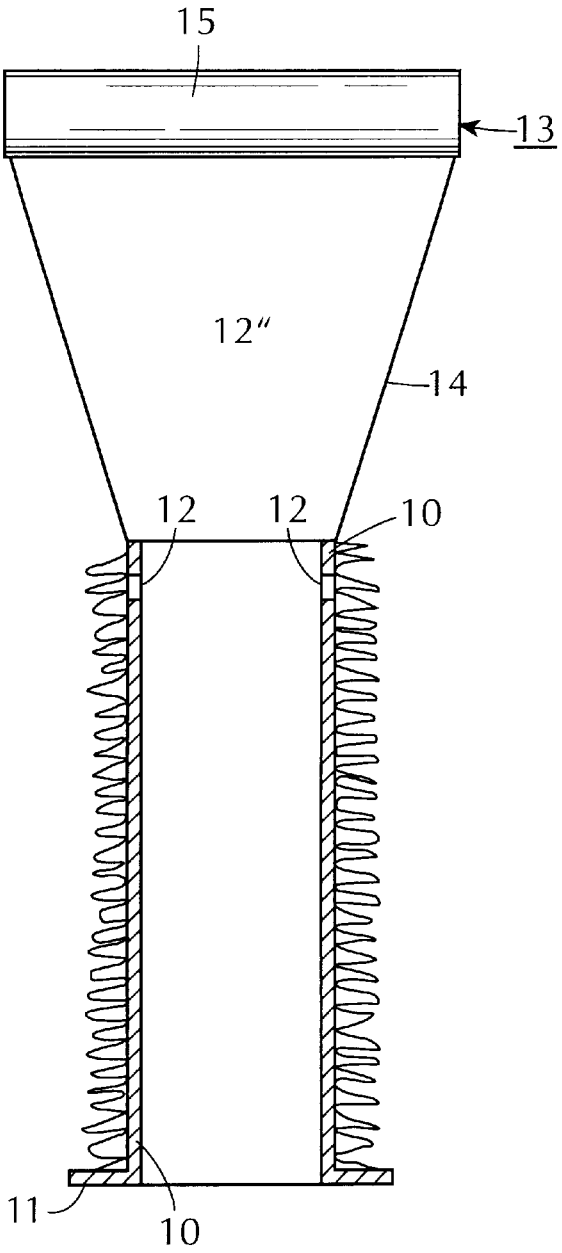
FIG. 1 illustrates a position of a mandrel drawing shuffling of a plastic tube onto the mandrel in accordance with the invention.

Referring to FIG. 1, the hollow cylindrical mandrel 10, for example, of aluminum, has a radially outwardly directed collar 11 at one end that is integral with the mandrel 10. The collar may also be made as a separate part to be mounted in place. The mandrel 10 also has a pair of diametrically opposed openings 12 at the upper end for purposes as described below.

A means 13 is provided above the mandrel 10 for delivering a continuous tube 14 of material onto the mandrel 10 and against the collar 11 in a collapsed state. As indicated, the means 13 is in the form of a roll 15 of flattened tube 14. In addition, the tube may be perforated to allow air to pass through to facilitate a filling operation or may be of mesh construction.

The tube 14 is of any material suitable for bagging purposes. For example, the tube 14 is made of plastic, namely, a polyethylene film of 1.5 mil. thickness and with an inside diameter of 24 inches. In this respect, the inside diameter of the tube 14 is larger than the outside diameter of the mandrel 10. Thus, as the tube 14 is delivered onto the mandrel 10, the tube 14 tends to collapse on itself in an accordion-like manner as illustrated.

The outside diameter of the mandrel 10 is 16 inches with a length of 48 inches. The length of tube 14 on the mandrel 10 is 600 feet and is, thus, of a length 150 times the length of the mandrel 10.

The tube 14 is delivered from the roll 15 in a flattened condition. Accordingly, air is blown into the tube from a suitable source (not shown) to open the tube 14 in order to facilitate fitting of the front end of the tube 14 onto the mandrel 10. The tube 14 is then shuffled, for example, by hand, onto the mandrel 10. After the mandrel 10 has been filled to capacity, the tube 14 is severed and further delivery ceases. Alternatively, a pre-determined length of tube 14 may be delivered onto the mandrel 10.

Figure 2:
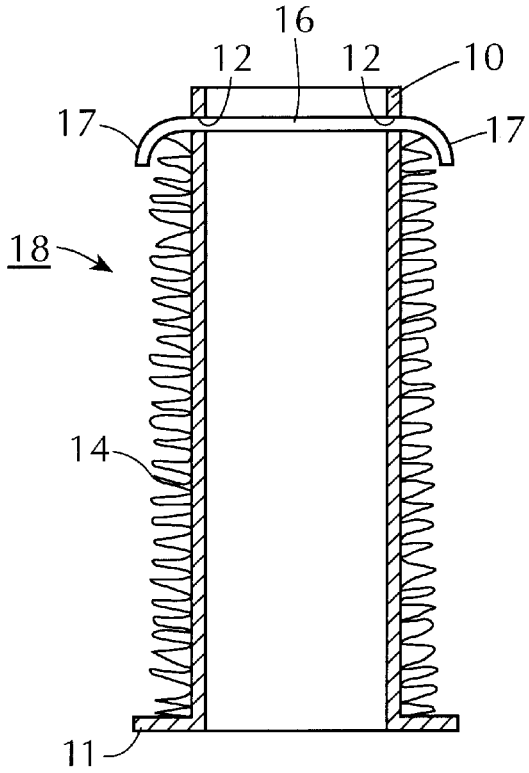
FIG. 2 illustrates a cross sectional view of a filled cartridge in accordance with the invention.

Referring to FIG. 2, after the mandrel 10 has been filled to capacity, a bar 16 is passed through the openings 12 to maintain the collapsed tube 14 place. As illustrated, the bar 16 has a pair of curved ends 17 and is rotatable between a position as illustrated in FIG. 2 with the curved ends facing downwardly in the direction of the collar 11 so as to retain the tube 14 in place and a second position facing upwardly for purposes as described below. In this way, a cartridge 18 is formed.

Figure 3:
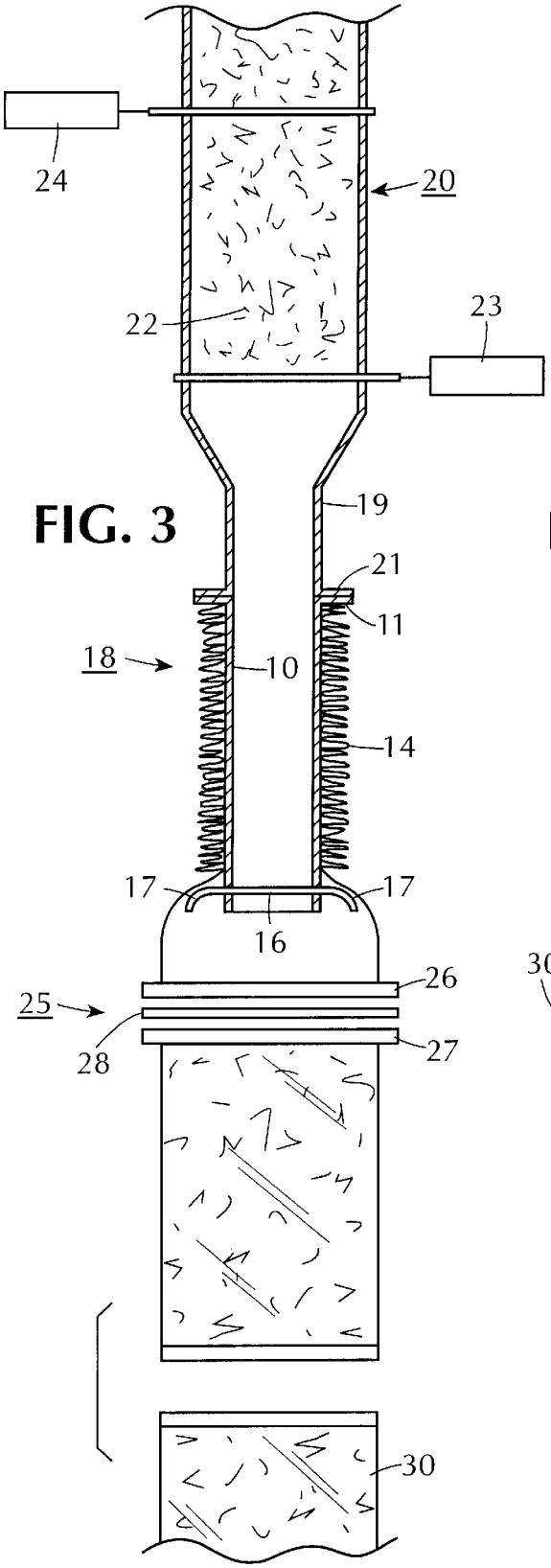
FIG. 3 illustrates a part-cross sectional view of a cartridge mounted on a chute of a bagging machine in accordance with the invention.
Figure 4:
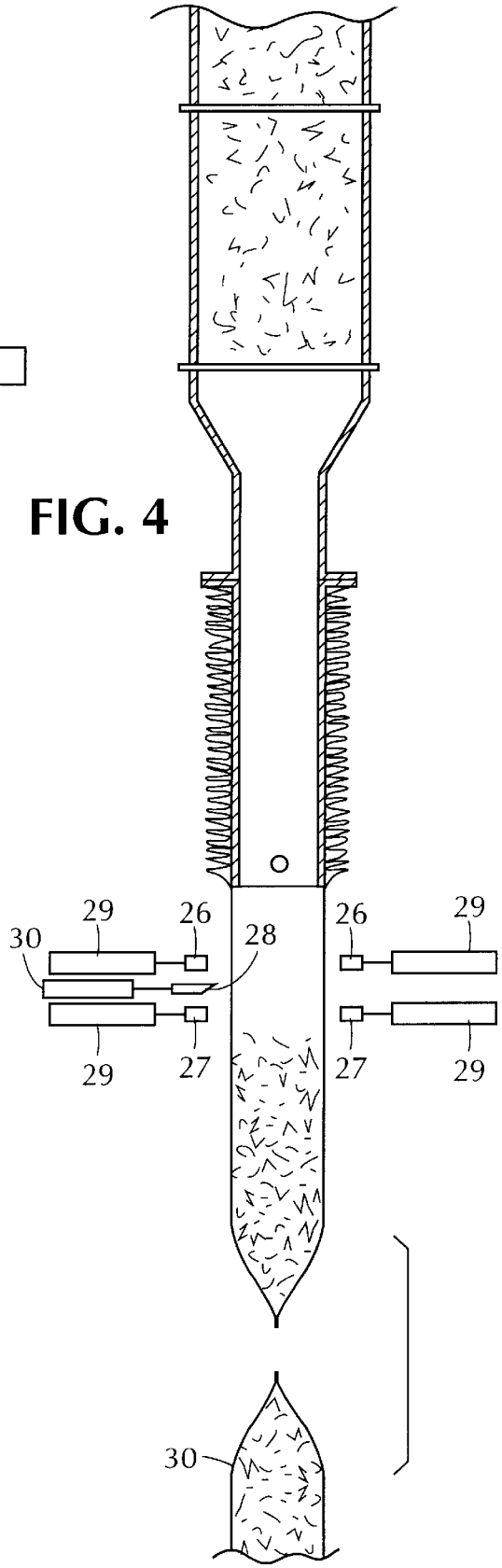
FIG. 4 illustrates a view similar to FIG. 3 turned 90 degrees.

Referring to FIGS. 3 and 4, wherein like reference characters indicate like parts as above, in use, the cartridge 18 is inverted and mounted in depending relation from a chute 19 of a bagging machine 20. In this respect, the collar 11 of a cartridge 18 is coupled in a suitable fashion to a similar collar 21 on the lower end of the chute 19.

After mounting of the cartridge 18 on the chute 19, the bar 16 is rotated into the second position so that the curved ends 17 of the bar face downwardly. In this position, the bar 16 still retains the collapsed tube 14 on the mandrel 10.

As illustrated, the hollow mandrel 10 has an inside diameter which is coextensive with the inside diameter of a chute 19 in order to provide a continuous passage for a flow of particulate material 22, such as loose fill material from the bagging machine 20. In this respect, the thickness or diameter of the bar 16 is relatively small compared to the passageway defined by the mandrel 10 so that the bar 16 offers little or no obstruction to the flow of the material 22.

As illustrated, the bagging machine 20 employs suitable means 23, 24 for forming a pre-determined charge of material 22 to be dispensed sequentially at intermittent time intervals from the bagging machine. Since this is a conventional structure, no further description is believed to be necessary.

The bagging machine also employs a means in the form of a heat sealing means 25 below the chute 19 for closing the tube to form a series of closed bags. As indicated, the heat sealing means 25 includes two pairs of heat seal bars 26, 27 that are disposed in vertically spaced apart relation. When the seal bars 26, 27 are brought together, a pair of transverse seals are formed in the plastic tube 14.

A severing means 28, for example a blade or hot wire, is disposed between the two pairs of vertically spaced seal bars 26, 27 in order to sever the tube 14 between the two transverse seals that are formed in the bag 14. Typically, the cutting blade would be serrated with sharp teeth (not shown) to cut through the bag between the stiffened heat sealed areas.

As shown in FIG. 4, a plurality of piston and cylinder arrangements 29 are provided for moving each heat seal bar 26,27 towards and away from the plastic tube 14 in order to effect a heat seal across the tube 14. Likewise, a piston and cylinder arrangement 30 is provided for moving the severing means 28 relative to the tube 14.

In use, after mounting the cartridge 18 on the chute 19, the bottom end of the tube 14 is manually pulled downwardly between the heat seal bars 26, 27. During this time, the tube 14 slides over and is spread outwardly by the curved ends of the bar 16. Thereafter, the sealing means 25 is operated automatically to form two transverse seals across the tube 14 while also severing the tube 14 between the two seals. The tube 14 below the cut is waste and may be discarded. The seal which is formed above the cut serves as the bottom of the "bag" which is to be formed.

With the sealing means 25 moved out of the path of the tube 14, the tube 14 is again pulled manually from the mandrel 10 to place a length of tube below the sealing means. The bagging machine 20 then operates so that a predetermined charge of particulate material 22 is dispensed through the chute 19 and mandrel 10 into the tube 14. Air may also be blown into the flow of particulate material to assist the flow and to open the tube 14. As the tube 14 is pulled from the mandrel, the curved ends 17 of the bar 16 serve to flatten the tube 14 to be engaged by the bars 26,27 of the sealing means 25 and to act as a brake to retard the movement of the tube 14 off of the mandrel 10.

After another time interval, the sealing means 25 is again operated to again form two seals in the tube 14 and the severing means 28 operated to sever the tube 14 between the two seals. At this time, the top of the "bag" 30 is formed while a bottom of the next "bag" is formed. The formed bag 30 then falls under gravity onto a conveyor (not shown) or other transport means for conveying the bag 30 to another station.

Once the first bag 30 has been formed, operation of the bagging machine 20 with the mandrel 18 thereon continues in the same fashion until a plurality of bags 30 have formed. Once the tube 14 on the mandrel 10 has been exhausted, the mandrel 10 may be removed from the chute 19 and replaced by a fresh cartridge 18.

In order to automate the operation of the bagging machine, the sealing means 25 may be constructed to pull the tube 14 from the mandrel 10. In this embodiment, the sealing means 25 is mounted in a manner to be moved in a parallelogram manner. That is to say, after the seal bars 26,27 have engaged the tube 14, the sealing means 25 is moved downwardly to a lowermost position. This allows the seal bars 26,27 to pull the tube 14 from the mandrel 10. The seal bars 26,27 are then moved apart to disengage from the tube 14 and to move out of the path of the tube 14 now filled with particulate material 22. Next, the sealing means is moved upwardly to an uppermost position from which the seal bars 26,27 may again engage the tube 14.

Figure 5:
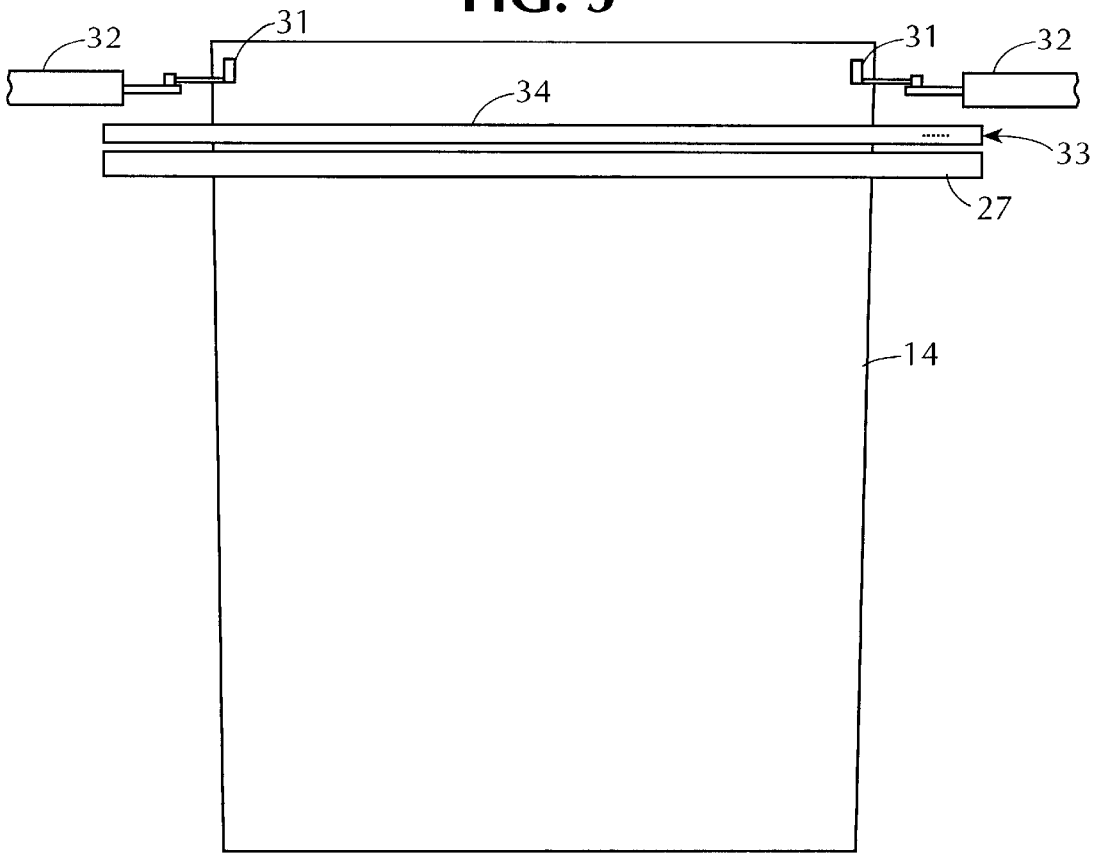
FIG. 5 illustrates a front view of a fly knife arrangement for severing a bag in accordance with the invention.
Figure 6:
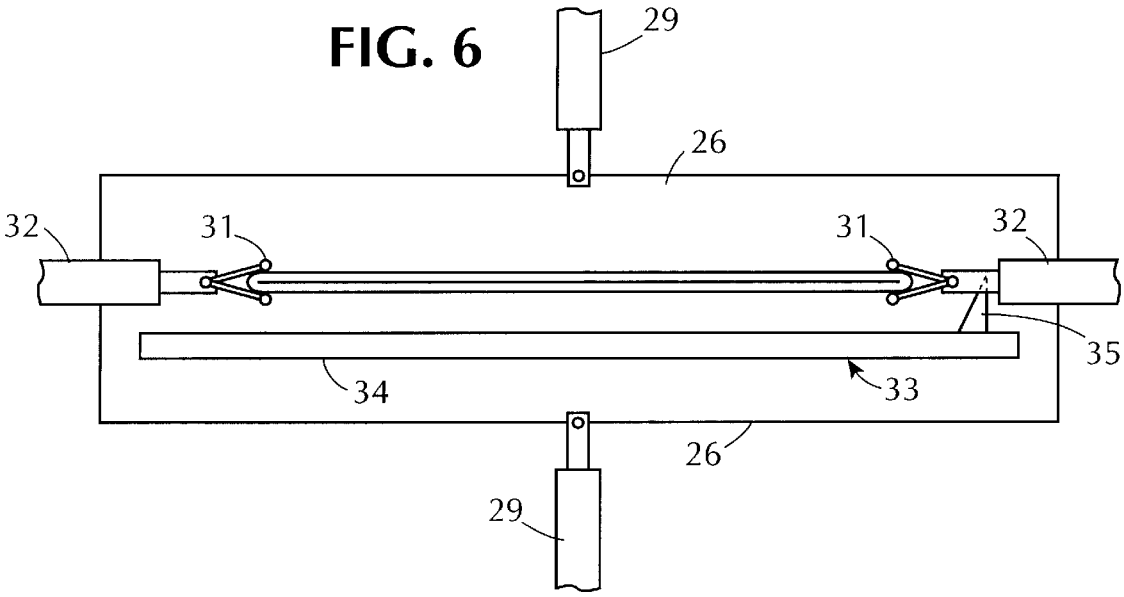
FIG. 6 illustrates a top view of the fly knife arrangement of FIG. 5.

Referring to FIGS. 5 and 6, wherein like reference characters indicate like parts as above, in order to improve the severance of the bags 30 from the tube 14, a pair of grippers 31 are positioned on opposite sides of the path of movement of the bag 14 and above the heat seal bars 26,27. Each gripper 31 has a pair of fingers for gripping the bag 14 therebetween and each gripper 31 is connected to a piston and cylinder unit 32 to be reciprocated between an extended position as shown in FIG. 5 and a retracted position closer to the opposite gripper 31. Actuation of the piston and cylinder units 32 occurs before the heat seal bars 26,27 come together in order to flatten the bag 14 for heat sealing purposes.

In addition, a fly knife arrangement 33 is mounted on one of the lower heat seal bars 27 and between the two sets of sealing bars 26,27 to effect severance of the bag 14 between the two heat sealed areas. The upper seal bars 26 are omitted form the illustration for purposes of illustrating the fly knife arrangement 33. This fly knife arrangement 33 includes a Lintra®-Lite Actuator 34 made by Norgen of Littleton, Colo. that is mounted on one of the lower seal bars 26 and a horizontally disposed knife 35 that is mounted on a slider of the actuator to be reciprocated across the bag 14 to sever the bag 14 between the two heat sealed areas.

Figure 7:
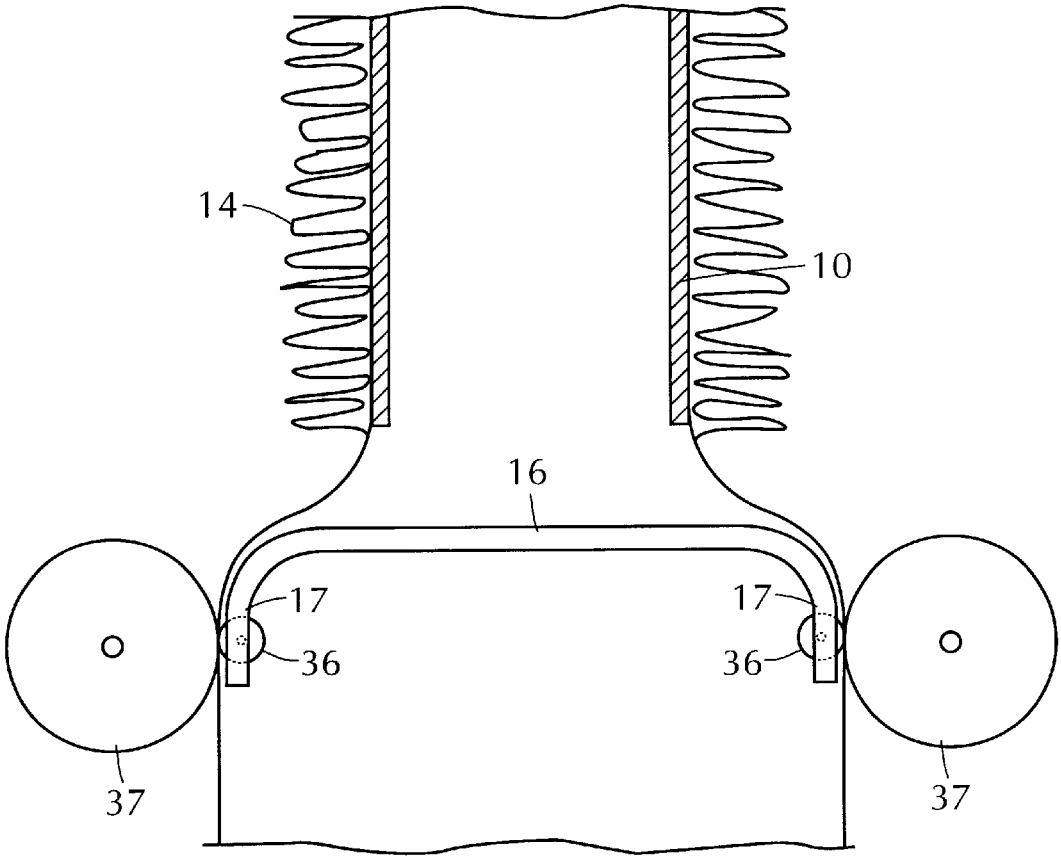
FIG. 7 illustrates a schematic view of a pair of rollers at the ends of the spreader bar for pulling a tube from the cartridge.

Further, in order to facilitate removal of the plastic tube 14 from the mandrel 10, a pair of rollers 36,37 may be located at each of the curved ends of the spreader bar 16 to grip the tube 14 in a nip as indicated in FIG. 7. One roller 36 of each pair is of an idler type that is mounted on a curved end of the spreader bar 16 via a releaseable coupling (not shown) to be located inside the tube 14. The other roller 37 is driven by a suitable means (not shown) and is located outside the tube 14. The rollers 36,37 are driven in synchronism with the bag filling operation to automatically pull the tube 14 from the mandrel 10.

Alternatively, the bag 14 may be pulled off the mandrel 10 by eliminating the idler roller 36 of each pair of rollers and having the driven roller 37 of each pair engage a curved end of the spreader bar 16 to form a nip within which to grip and pull the bag 14 off the mandrel 10.

The means for closing the tube 14 may also use a gathering and stapling mechanism, such as described in U.S. Pat. No. 6,035,606.

Figure 8:
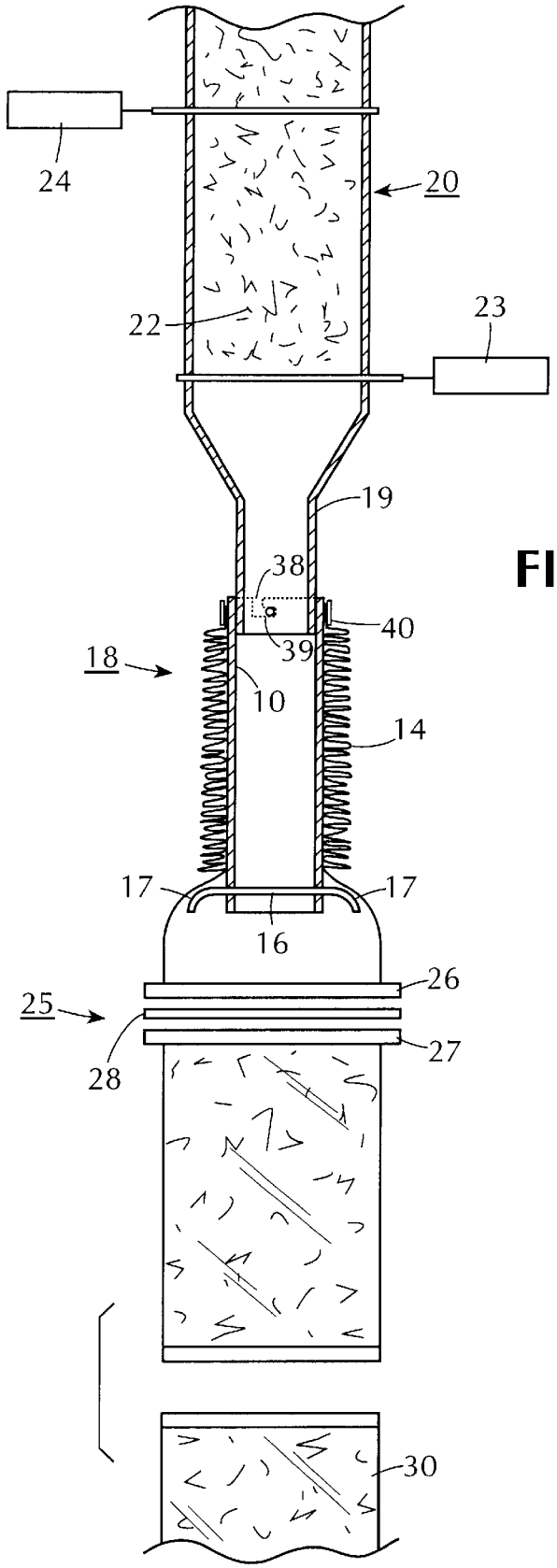
FIG. 8 illustrates a view of a modified mandrel in accordance with the invention.

Referring to FIG. 8, wherein like characters indicate like parts as above, the mandrel 10 may be formed with a collar. In this embodiment, the means for securing the mandrel 10 to a chute (not shown) is in the form of a pair of diametrically disposed L-shaped slots 38 (only one of which is shown) at one end of the mandrel for receiving a pair of outwardly projecting pins 39 (only one of which is shown) on the chute 19 in a bayonet type connection. In addition, the means for holding the tube 14 in place is formed by an adhesive tape 40 that secures one end of the tube 14 to the mandrel 10 and a second removable adhesive tape (not shown) that secures the other end of the tube 14 to the mandrel 10. When the mandrel 10 has been mounted on the chute 19, the bar 17 is slid into place and the tape at that end is removed so that the tube 14 may be drawn off as described above.

In this latter embodiment, the tube 14 is shuffled onto the mandrel 10 in a manner as above. However, the mandrel 10 may be mounted on or against any suitable surface that prevents the forward end of the tube 14 for sliding off the mandrel 10 before the tape 40 can be applied. After filling of the mandrel, the second tape is applied to hold that end of the tube 14 in place. The mandrel and tube may then be shipped to a user.

One advantage of this latter embodiment is that the cartridge is of cylindrical form and as such occupies less space than the embodiment that uses a collar on one end of the mandrel. Another advantage is that the bar is not shipped with the mandrel thereby reducing the occupied space and reducing weight. A user would then have a bar that can be used multiple times by being inserted into each fresh cartridge as a used cartridge is replaced.

The mandrel 10 may be made of any suitable material, such as plastic or metal, and particularly for disposable use, cardboard or paper.

The invention thus provides a cartridge containing a relatively long length of plastic tubing that may be used for forming a plurality of bags with particulate material, such as loose fill material.

The invention further provides a cartridge which may be easily replenished with a fresh length of tubing and which may be easily transported and fitted to a bagging machine.

The invention further provides a cartridge that requires little manual labor to begin use and which is able to be used automatically once a bagging operation has been initiated.

What is claimed is:

1. In combination a bagging machine having a chute for dispensing a flow of material; and a cartridge removably mounted on said chute in depending relation, said cartridge including a hollow mandrel for receiving a flow of material from said chute at one end, a collapsed tube of material disposed on said mandrel to form a bag to receive a flow of material passing through said mandrel and a removably mounted bar mounted in an opposite end of said mandrel, said bar having ends projecting from said mandrel to maintain said tube of material on said mandrel.

2. The combination as set forth in claim 1 wherein said cartridge further includes a radially outwardly directed collar at an upper end of said mandrel to maintain said collapsed tube thereon.

3. The combination as set forth in claim 1 wherein said chute has a pair of outwardly projecting pins and said cartridge has a pair of L-shaped slots receiving said pins for securing said cartridge to said chute.

4. The combination as set forth in claim 1 wherein said bar has a pair of curved ends and is rotatable in said mandrel between a first position with said curved ends facing upwardly to maintain said collapsed tube on said mandrel and a second position with said curved ends facing downwardly to cause spreading of said tube during movement of said tube over said bar and off said mandrel.

5. The combination as set forth in claim 1 further comprising means downstream of said mandrel for forming a series of spaced apart transverse seals in said tube to define a series of closed bags of the material dispensed through said mandrel.

6. The combination as set forth in claim 5 wherein said means is a heat sealing means below said chute, said heat sealing means including two pairs of heat seal bars disposed in vertically spaced apart relation for forming a pair of transverse seals in said tube.

7. The combination as set forth in claim 6 further comprising a severing means disposed between said two pairs of vertically spaced seal bars for severing said tube between said pairs of vertically spaced seal bars.

8. The combination as set forth in claim 7 wherein said severing means is a cutting blade.

9. The combination as set forth in claim 7 wherein said severing means is a fly knife arrangement.

10. The combination as set forth in claim 1 further comprising a pair of rollers, each said roller defining a nip with a respective end of said bar for passage of said tube therebetween.

11. The combination as set forth in claim 1 further comprising an idler roller mounted on a curved end of said bar to be located inside said tube and a driven roller for forming a nip with said idler roller and located outside said tube to pull said tube from said mandrel.

12. The combination as set forth in claim 1 further comprising at least one driven roller for forming a nip with said bar and located outside said tube to pull said tube from said mandrel.

13. A cartridge for mounting on a chute of a bagging machine, said cartridge including a hollow mandrel for receiving a flow of material from the chute;

a collapsed tube of material disposed on said mandrel for dispensing therefrom to form a series of bags for receiving the material dispensed through said mandrel; and a bar removably mounted in a lower end of said mandrel, said bar having ends projecting from said mandrel to maintain said tube of material on said mandrel.

14. A cartridge as set forth in claim 13 wherein said bar has a pair of curved ends and is rotatable in said mandrel between a first position with said curved ends facing upwardly to maintain said collapsed tube on said mandrel and a second position with said curved ends facing downwardly to cause spreading of said tube during movement of said tube over said bar and off said mandrel.

15. A cartridge as set forth in claim 13 wherein said cartridge further includes a collar on said mandrel opposite said bar to maintain said collapsed tube thereon.

16. A cartridge as set forth in claim 13 wherein said mandrel is cylindrical and has a predetermined length and wherein said tube has a length of at least 20 times the length of said mandrel.

17. A cartridge for mounting on a chute of a bagging machine, said cartridge including a hollow mandrel having means at one end for securement to a chute of a bagging machine in depending relation for receiving a flow of material from the chute;

a collapsed tube of material disposed on said mandrel for dispensing therefrom to form a series of bags for receiving the material dispensed through said mandrel;

means at each end of said mandrel for holding said collapsed tube of material on said mandrel; and a pair of diametrically disposed openings in said mandrel for receiving a bar therein to retain the collapsed tube thereon.

18. A cartridge as set forth in claim 17 wherein said tube is a mesh tube having a plurality of openings therein.

19. A cartridge as set forth in claim 17 wherein said means at said one end of said cartridge is a radially extending flange.

20. A cartridge as set forth in claim 17 wherein said means at said one end of said cartridge includes a pair of diametrically disposed L-shaped slots in said cartridge for receiving outwardly extending pins on the chute.

21. A cartridge as set forth in claim 17 wherein said means at each end of said mandrel for holding said collapsed tube is a removable tape.

22. In combination a hollow mandrel having a radially outwardly directed collar at a lower end thereof;

means for delivering a continuous tube of plastic film onto said mandrel and against said collar in a collapsed state; and a bar for slidable mounting in an upper end of said mandrel after delivery of a collapsed tube of plastic film thereon, said bar having ends projecting from said mandrel to maintain the plastic film on said mandrel for transport purposes.

23. The combination as set forth in claim 22 wherein said means is a roll of flattened plastic tube.

24. The combination as set forth in claim 22 wherein said means is a roll of flattened mesh tube.

* * * * *